US011787651B2

(12) United States Patent
Tok et al.

(10) Patent No.: US 11,787,651 B2
(45) Date of Patent: Oct. 17, 2023

(54) ACTUATION OF PICK MECHANISMS FOR MEDIA STACK HEIGHT SENSING BASED ON NUMBER OF PRINTED SHEETS

(71) Applicant: Hewlett-Packard Development Company, L.P., Spring, TX (US)

(72) Inventors: Wee Hien Tok, Singapore (SG); Yong Seng Pun, Singapore (SG); Wei Lit Teoh, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 185 days.

(21) Appl. No.: 17/521,570

(22) Filed: Nov. 8, 2021

(65) Prior Publication Data

US 2023/0141085 A1 May 11, 2023

(51) Int. Cl.

| | |
|---|---|
| ***B65H 3/06*** | (2006.01) |
| ***B65H 43/06*** | (2006.01) |
| ***B65H 7/02*** | (2006.01) |

(52) U.S. Cl.

CPC ..... *B65H 3/0684* (2013.01); *B65H 7/02* (2013.01); *B65H 43/06* (2013.01); *B65H 2511/15* (2013.01); *B65H 2511/30* (2013.01); *B65H 2801/27* (2013.01)

(58) Field of Classification Search

CPC .... B65H 3/0684; B65H 2511/15; B65H 7/02; B65H 2511/30; B65H 43/06; B65H 2801/27

See application file for complete search history.

(56) References Cited

U.S. PATENT DOCUMENTS 10,994,560 B2 * 5/2021 Teoh ..... B65H 3/0684

* cited by examiner

*Primary Examiner* — Jeremy R Severson

(74) *Attorney, Agent, or Firm* — Brooks, Cameron & Huebsch, PLLC

(57) ABSTRACT

According to examples, an apparatus may include a processor and a memory on which are stored computer-readable instructions that, when executed by the processor, may cause the processor to receive a first sheet count before execution of a print job, receive a second sheet count after execution of the print job, and determine a number of sheets printed for the print job based on the first sheet count and the second sheet count. The processor may update a pick mechanism activation counter value based on the determined number of printed sheets. Based on a determination that the updated pick mechanism activation counter value is greater than or equal to a predetermined threshold value, the processor may cause a pick mechanism to be actuated to sense a media stack height of print media.

15 Claims, 5 Drawing Sheets

ACTUATION OF PICK MECHANISMS FOR MEDIA STACK HEIGHT SENSING BASED ON NUMBER OF PRINTED SHEETS

BACKGROUND

During printing processes, printers may report media stack heights of print media contained in media trays. Some types of printers may use pick mechanisms to sense the media stack heights.

BRIEF DESCRIPTION OF THE DRAWINGS

Features of the present disclosure are illustrated by way of example and not limited in the following figure(s), in which like numerals indicate like elements, in which.

DETAILED DESCRIPTION

Figure 1:
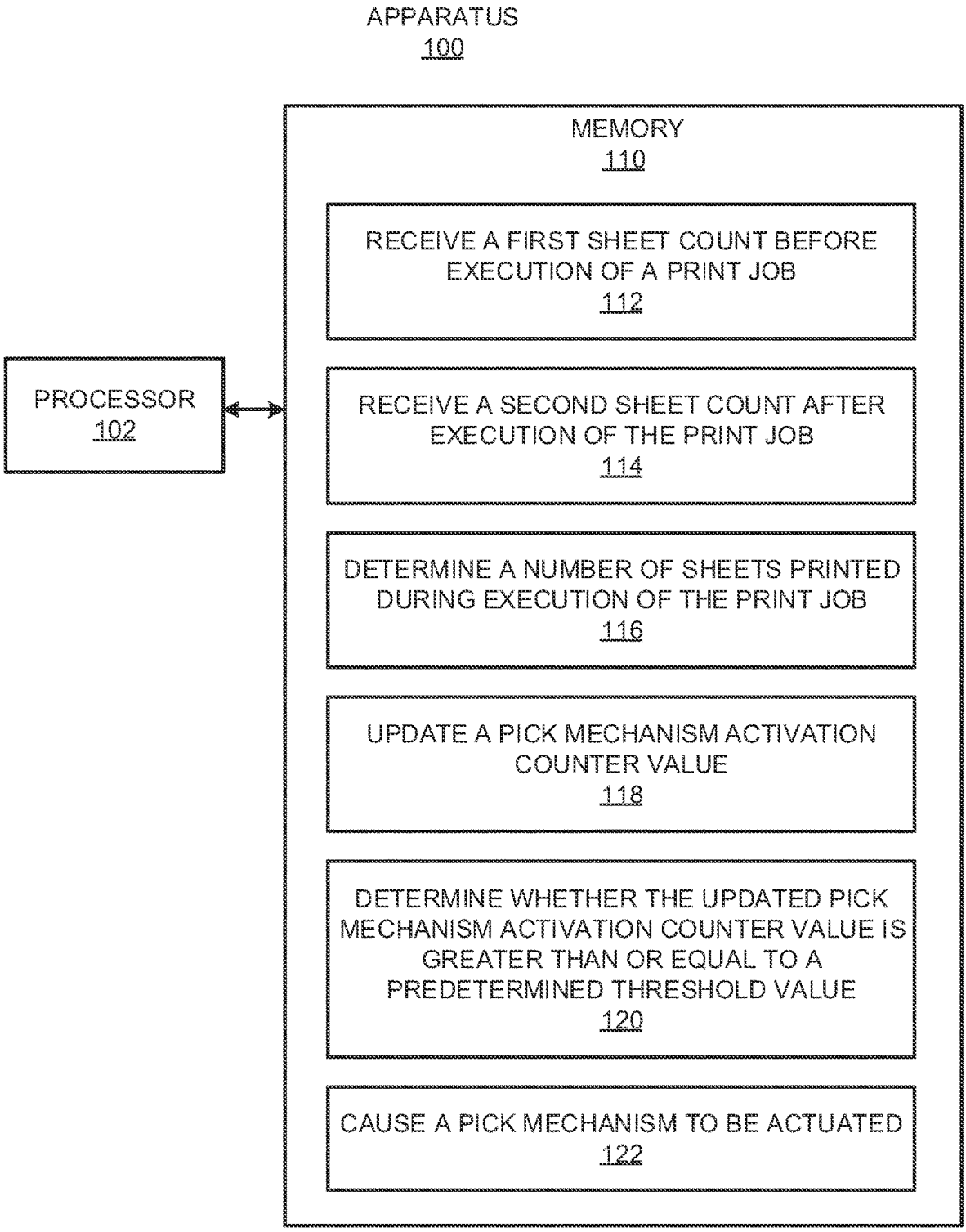
FIG. 1 depicts a block diagram of an example apparatus that may update a pick mechanism activation counter value and, based on a determination that the updated pick mechanism activation counter value is greater than or equal to a threshold value, may cause a pick mechanism to be actuated to sense a media stack height of print media.

For simplicity and illustrative purposes, the present disclosure is described by referring mainly to examples. In the following description, numerous specific details are set forth in order to provide a thorough understanding of the present disclosure. It will be readily apparent however, that the present disclosure may be practiced without limitation to these specific details. In other instances, some methods and structures have not been described in detail so as not to unnecessarily obscure the present disclosure.

Throughout the present disclosure, the terms "a" and "an" are intended to denote at least one of a particular element. As used herein, the term "includes" means includes but not limited to, the term "including" means including but not limited to. The term "based on" means based at least in part on.

Generally, with increasing adoption of a print-anywhere paradigm, printing devices may increasingly report levels of print media remaining in the input trays of printing devices. Printing devices, such as desktop printers, may use mechanical pick mechanisms, or pick arms, to sense a media stack height of the print media remaining in the input trays.

Concerns associated with implementations of mechanical pick mechanisms to sense media height may be that, in some instances, the structural reliabilities and/or the life spans of the mechanical components of the pick mechanisms may be degraded, oftentimes to be less than the expected life spans of the pick mechanisms when the pick mechanisms are not used for media stack height measurements and/or the life spans of other components of the printing devices.

By way of particular example, the pick mechanisms may perform a hard stop homing move in order to zero a measurement system, which may impart a relatively large amount of mechanical stress to components of the pick mechanism. In some examples, pick mechanisms may be used to sense the media stack height based on movements of the pick mechanism relative to the print media in an input tray. In order to measure accurate media stack heights, the pick mechanism may establish a reliable reference position, also referred to herein as a home position or a "0" position, along an operation of the pick mechanism. For instance, the pick mechanism may establish the reference position at one end of a range of motion of the pick mechanism, such as at a fully lifted position. The pick mechanism may determine the media stack height based on movement of the pick mechanism from the reference position to a top of the media stack in the input tray.

In this regard, accuracy of media stack height measurements based on the pick mechanisms may depend on a reliability of the reference position. Pick mechanisms may include various types of mechanisms, such as rotary type pick mechanisms or linear type pick mechanisms. For each of the various types of pick mechanisms, in order to establish reliable reference positions, the pick mechanisms used may push to a hard stop. In this regard, the homing moves may be performed with relatively large amounts of force, or torque, to provide reliable reference positions. Insufficient amounts of force in the homing moves may result in insufficient biasing against hard stops, which may produce unreliable reference positions.

In some examples, such hard stop homing moves may be performed each time the media stack height is to be sensed, which may be after each print job. In some printing device implementations, the average number of pages per print job may be relatively low, for instance around 2 pages per print job. In such instances, the average number of sheets per print job may be as low as 1 sheet per print job, particularly since 2 pages may be printed on 1 sheet in cases of duplex printing. As a result, relatively large numbers of mechanical actuations per printed sheets may occur. The relatively large numbers of mechanical stresses to the pick mechanisms over many print jobs may lead to premature mechanical failure of the pick mechanisms and/or other components in the printing devices.

Disclosed herein are apparatuses, systems, methods, and computer-readable media in which rates of mechanical media stack height sampling may be reduced. The reduction in the rates of mechanical medial stack height sampling may improve failure rates and may extend the service lives of mechanical components for sensing media stack height as well as other functions in printing devices. In some examples, a processor may reduce rates of media stack height sampling by using a pick mechanism activation counter to control an operation of a pick mechanism. For instance, the processor may receive a sheet count before and after execution of a print job, and may determine a number of sheets printed for the print job based on the received sheet counts. The processor may update a pick mechanism activation counter value based on the determined number of printed sheets. In some examples, based on a determination that the updated pick mechanism activation counter value is greater than or equal to a predetermined threshold value, the processor may cause the pick mechanism to be actuated to sense a media stack height of print media.

By enabling control of pick mechanisms as disclosed herein, which may include causing the pick mechanisms to be actuated for media stack height measurements based on a predetermined threshold number of printed sheets, a number of actuations of the pick mechanisms may be reduced. This may improve the service lives of the pick mechanisms and reduce costs associated with re-design and/or repair of components that may be susceptible to premature failure. Additionally, the processor may cause a sampling rate for media stack height sensing to be controlled, which may improve flexibility and enable balancing between improved service life of the pick mechanisms and accuracy of the media stack height measurements. This may also improve efficiency and speed of the printing devices as a fewer number of media stack height measurements may be needed, which in turn may reduce consumption of computing resources and/or energy resources.

Figure 2:
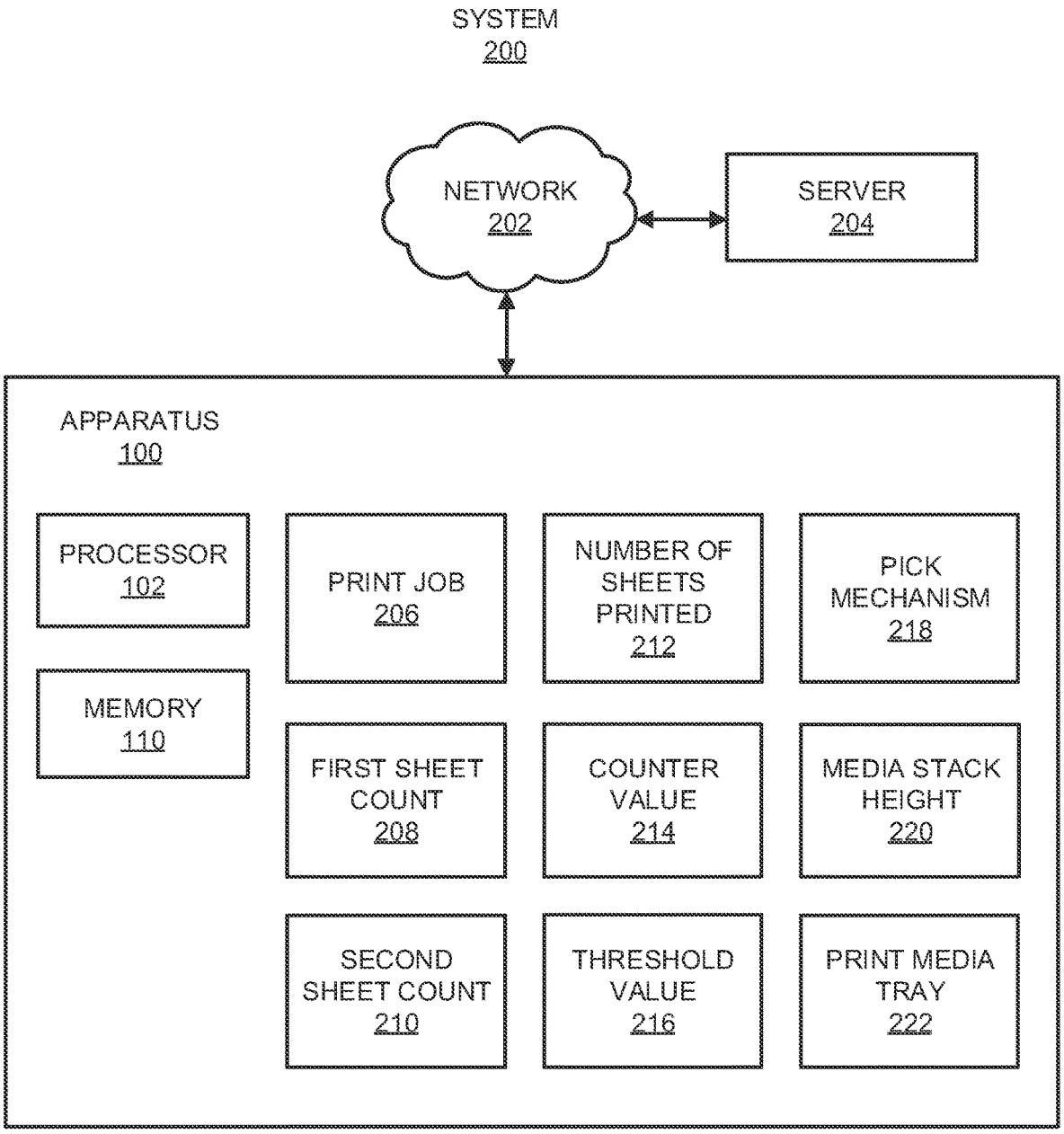
FIG. 2 depicts a block diagram of an example system within which the example apparatus depicted in FIG. 1 may be implemented.

Reference is made to FIGS. 1 and 2. FIG. 1 depicts a block diagram of an example apparatus 100 that may update a pick mechanism activation counter value and, based on a determination that the updated pick mechanism activation counter value is greater than or equal to a threshold value, may cause a pick mechanism to be actuated to sense a media stack height of print media. FIG. 2 depicts a block diagram of an example system 200 within which the example apparatus 100 depicted in FIG. 1 may be implemented. It should be understood that the apparatus 100 depicted in FIG. 1 and the system 200 depicted in FIG. 2 may include additional features and that some of the features described herein may be removed and/or modified without departing from the scopes of the apparatus 100 and/or the system 200.

In some examples, the apparatus 100 may be implemented in a computing device, a printing device (such as an inkjet printer, a laser printer, a photo printer, or the like), a server, a scanner, and/or the like. As shown, the apparatus 100 may include a processor 102 and a non-transitory computer-readable medium, e.g., a memory 110. The processor 102 may be a semiconductor-based microprocessor, a central processing unit (CPU), an application specific integrated circuit (ASIC), a field-programmable gate array (FPGA), and/or other hardware device. Although the apparatus 100 is depicted as having a single processor 102, it should be understood that the apparatus 100 may include additional processors and/or cores without departing from a scope of the apparatus 100 and/or system 200. In this regard, references to a single processor 102 as well as to a single memory 110 may be understood to additionally or alternatively pertain to multiple processors 102 and/or multiple memories 110.

As depicted in FIG. 2, the apparatus 100 may be implemented in a system 200, which may include a server 204 that is connected to a data store (not shown). The apparatus 100 may be in communication with the server 204 via a network 202.

The memory 110 may be an electronic, magnetic, optical, or other physical storage device that contains or stores executable instructions. The memory 110 may be, for example, Read-Only Memory (ROM), flash memory, solid state drive, Random-Access memory (RAM), an Electrically Erasable Programmable Read-Only Memory (EEPROM), a storage device, an optical disc, or the like. The memory 110 may be a non-transitory computer-readable medium. The term "non-transitory" does not encompass transitory propagating signals.

As shown in FIG. 1, the processor 102 may execute instructions 112-122 to cause an operation of a pick mechanism within the apparatus 100 to be controlled. The instructions 112-122 may be computer-readable instructions, e.g., non-transitory computer-readable instructions. In other examples, the apparatus 100 may include hardware logic blocks or a combination of instructions and hardware logic blocks to implement or execute functions corresponding to the instructions 112-122.

The processor 102 may fetch, decode, and execute the instructions 112 to receive a first sheet count 208 before execution by a printing device (e.g., the apparatus 100 or a printing device connected to the apparatus 100) of a print job 206. In some examples, the printing device may maintain a print count that represents a running total or a cumulative number of sheets printed in the printing device. The first sheet count 208 may be a value of the print count at a particular point in time, e.g., before execution by the printing device of the print job 206. The print count as well as the first sheet count 208 may be stored in the memory 110, for instance, in a non-volatile memory on a main board (now shown) of the printing device. e.g., a motherboard, or the like of the printing device. In some examples, the print job 206 may include a file or a set of files that may be submitted to the printing device (e.g., apparatus 100 or a printing device connected to the apparatus 100) for printing. The print job 206 may include information regarding an image to be printed, media size, number of copies, priority, and/or the like. In some examples, the processor 102 may maintain the print count for the running total of sheets printed based on sheet count information included in the received print job 206, based on sheet detection through the printing device, and/or the like.

The processor 102 may fetch, decode, and execute the instructions 114 to receive a second sheet count 210 after execution by the printing device of the print job 206. In some examples, the first sheet count 208 and the second sheet count 210 may be numerical values, which are greater than one. The second sheet count 210 may be a value of the print count maintained at the printing device at a particular point in time, e.g., after execution by the printing device of the print job 206. The second sheet count 210 may be stored in the memory 110, for instance, in a non-volatile memory on a main board (not shown) of the printing device, e.g., a motherboard, or the like of the printing device.

The processor 102 may fetch, decode, and execute the instructions 116 to determine a number of sheets printed 212 for the print job 206 based on the first sheet count 208 and the second sheet count 210. The processor 102 may calculate the number of sheets printed 212 based on a difference between the second sheet count 210 and the first sheet count 208. The processor 102 may end the print job 206.

The processor 102 may fetch, decode, and execute the instructions 118 to update a pick mechanism activation counter value 214 based on the determined number of sheets printed 212. In some examples, the pick mechanism activation counter value 214 may be a counter value that represents a number of sheets printed since a previous media stack height sensing event. The processor 102 may increment the pick mechanism activation counter value 214 by the determined number of sheets printed 212 for the print job 206 to update the pick mechanism activation counter value 214.

In some examples, the pick mechanism activation counter value 214 may be a value that is carried forward from a previous print job. In these instances, the processor 102 may increment the carried forward value of the pick mechanism activation counter value 214 from the previous print job by the determined number of sheets printed 212 in the print job 206.

The processor 102 may fetch, decode, and execute the instructions 120 to determine whether the updated pick mechanism activation counter value 214 is greater than or equal to a predetermined threshold value 216. In some examples, the predetermined threshold value 216 may represent a minimum number of sheets to be printed before performing a media stack height measurement. A relatively greater value for the predetermined threshold value 216 may reduce a rate of media stack height sensing. The processor 102 may determine whether the updated pick mechanism activation counter value 214 is greater than or equal to the predetermined threshold value 216 or, equivalently, less than the predetermined threshold value 216.

The processor 102 may fetch, decode, and execute the instructions 122 to cause a pick mechanism 218 to be actuated to sense a media stack height 220 of print media based on a determination that the updated pick mechanism activation counter value 214 is greater than or equal to the predetermined threshold value 216. By way of particular example and for purposes of illustration, the predetermined threshold value 216 may be set to 5 sheets printed, and based on a determination that the updated pick mechanism activation counter value 214 is greater than 5, such that more than 5 sheets have been printed since the previous actuation of the pick mechanism 218, the processor 102 may cause the pick mechanism 218 to be actuated. In some examples, the apparatus 100 may include a print media tray 222, and the processor 102 may cause the pick mechanism 218 to sense the media stack height 220 present in the print media tray 222.

In some examples, the predetermined threshold value 216 may be set to balance structural reliability of the pick mechanism 218 versus accuracy of the media stack height measurements. For instance, a relatively lower rate of media stack height sensing may reduce the total number of actuations and may thus increase the life span of the pick mechanism 218. In contrast, a relatively higher rate of media stack height sensing may increase the accuracy of the media stack height measurements, buy may also increase a number of fatigue cycles in the pick mechanism 218, which may lead to a lower life span. The predetermined threshold value 216 may be determined through testing, developer knowledge, modeling, real-world determinations, and/or the like.

Once the pick mechanism 218 is actuated, the processor 102 may determine the sensed media stack height 220 using the pick mechanism 218. In some examples, the sensed media stack height 220 may represent a raw stack height reading, and the processor 102 may generate a corrected value for the media stack height 220 using the data fusion model based on the raw stack height reading, previous stack height readings, and recent printed sheets since the last stack height reading. The data fusion model may be a linear regression model, or the like. In some examples, the processor 102 may correct the sensed media stack height 220 by accounting for the number of sheets printed 212 since a previous stack height reading, using the linear regression model. The data fusion model may be referred to herein as a media stack height correction model. The processor 102 may output the corrected media stack height 220, for instance, to UI clients or to print services that may reside on the server 204.

In some examples, the processor 102 may initialize the updated pick mechanism activation counter value 214 to a predetermined initial value when the pick mechanism 218 is actuated. For instance, the processor 102 may reset the pick mechanism activation counter value 214 to 0. Initialization of the pick mechanism activation counter value 214 with each actuation of the pick mechanism 218 may reduce errors, such as missed pick mechanism actuation events. By way of particular example and for purposes of illustration, in a case in which the pick mechanism activation counter value 214 is not initialized when the pick mechanism 218 is actuated, the processor 102 may use a rolling printed sheet counter value, such as the print count as previously described, or the like. For instance, the processor 102 may apply a modulus operation to the rolling printed sheet counter value and may actuate the pick mechanism 218 based on a comparison of a modulus to the predetermined threshold value 216. However, in these instances, some pick mechanism actuation events may be missed in cases where the modulus equals 0, such as when the number of sheets printed 212 may equal the predetermined threshold value 216. In order to avoid such errors, the processor 102 may initialize the updated pick mechanism activation counter value 214 with each actuation of the pick mechanism 218. Once the updated pick mechanism activation counter value 214 is initialized, the processor 102 may proceed to the next print job with the pick mechanism activation counter value 214 set to 0.

Based on a determination that the updated pick mechanism activation counter value 214 is less than the predetermined threshold value 216, the processor 102 may prevent operation of the pick mechanism 218 to sense the media stack height 220 of the print media. In some examples, the processor 102 may cause a state of the pick mechanism 218 to be set in a standby mode to prevent operation of the pick mechanism 218. The processor 102 may carry forward the updated pick mechanism activation counter value 214 for use in a subsequent print job. Returning to the previous example in which the predetermined threshold value 216 is set to 5, in a case in which the updated number of sheets printed 212 is 3, which is less than the predetermined threshold value 216, the processor 102 may carry forward this value as the pick mechanism activation counter value 214 for a subsequent print job. In this example, the processor 102 may prevent operation of the pick mechanism 218 until the number of sheets printed 212 in the subsequent print job(s) is 2 or greater, so that the pick mechanism activation counter value 214 is incremented to be greater than or equal to the threshold value 216 of 5.

In some examples, the processor 102 may initialize the pick mechanism activation counter value 214 based on a predetermined event. For instance, based on a determination of a printing device start-up, the processor 102 may initialize the pick mechanism activation counter value 214 to a predetermined initial value, such as 0.

In some examples, the processor 102 may adjust a rate in which the pick mechanism 218 is to be actuated. The predetermined threshold value 216 may correlate to an accuracy of the media stack height measurement and a life span of the pick mechanism 218. In some examples, the processor 102 may decrease the predetermined threshold value 216 to increase a rate at which the pick mechanism 218 may be actuated, which may increase the accuracy of the media stack height measurement. In some examples, the processor 102 may increase the predetermined threshold value 216 to decrease the rate in which the pick mechanism 218 may be actuated, which may increase the life span of the pick mechanism 218.

In some examples, based on a predetermined event that may cause a model to be generated, the processor 102 may override the pick mechanism activation counter value 214 by causing the pick mechanism 218 to be actuated to sense the media stack height 220 of print media in an input tray while the updated pick mechanism activation counter value 214 is less than the predetermined threshold value 216. The model may be referred to herein as a media stack height correction model.

For instance, the processor 102 may cause the pick mechanism 218 to be actuated to sense the media stack height 220 of the print media in the input tray regardless of the value of the pick mechanism activation counter value 214. As previously described, the processor 102 may generate a corrected media stack height using a model, such as a linear regression model, which may account for the number of sheets printed 212 in the print job 206 to the media stack height 220. The media stack height 220 may be a raw sensed height value determined using the pick mechanism 218 and the model may adjust this value based on the number of sheets printed 212 and previous media stack height measurements. In some examples, the model may be reset, for instance, when an input tray is removed from and re-inserted into the apparatus 100, in which case a media stack height may be unknown since a user may fill the print media tray to any level. In these instances, the processor 102 may override the pick mechanism activation counter value 214 in order to obtain additional data points to rebuild the model for stack height correction. The processor 102 may cause the pick mechanism 218 to be actuated to sense the media stack height 220 of print media while the updated pick mechanism activation counter value 214 is less than the predetermined threshold value 216. The processor 102 may override the pick mechanism activation counter value 214 for a predetermined number of actuations of the pick mechanism 218.

Figure 3:
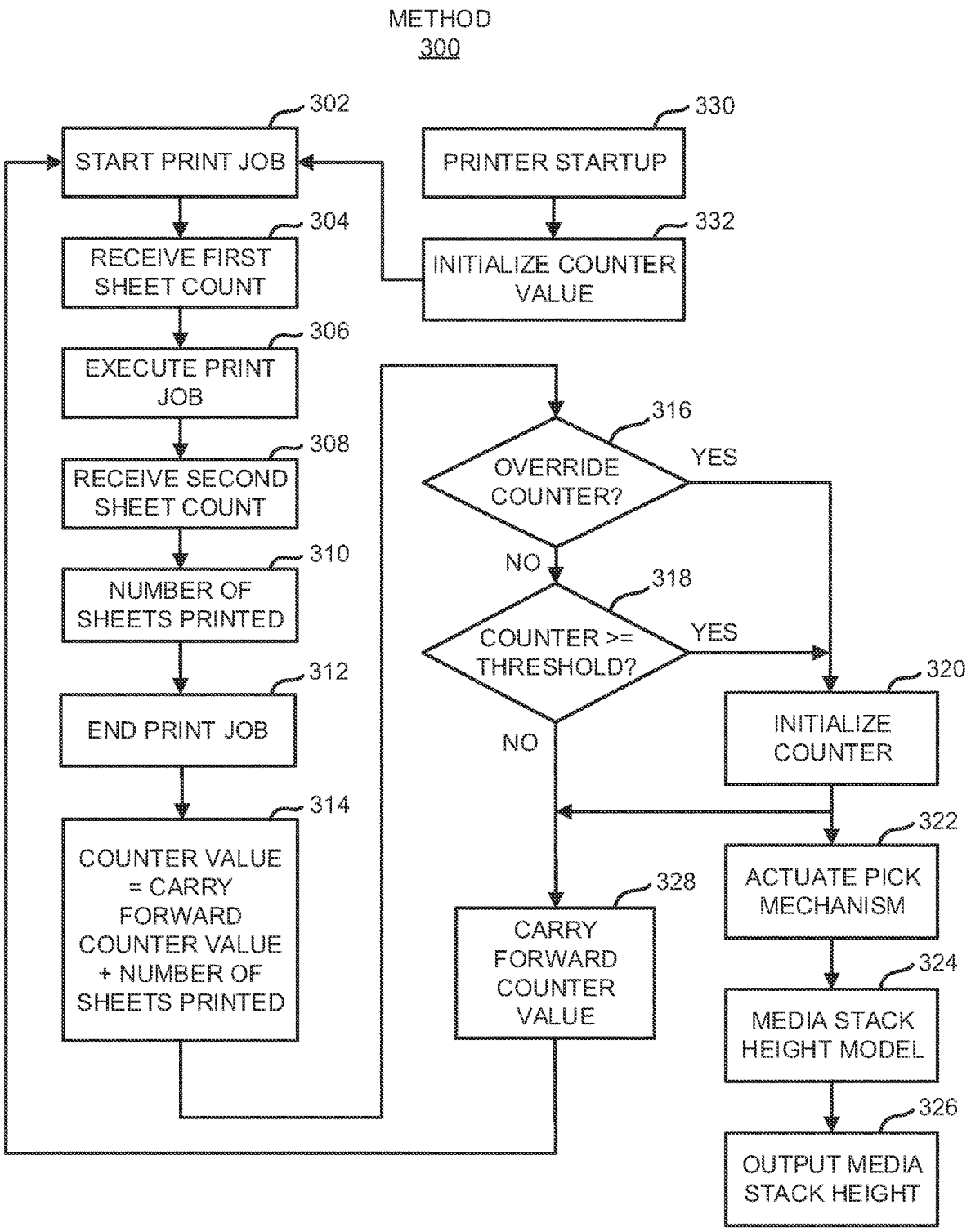
FIG. 3 depicts a flow diagram of an example method for updating a pick mechanism activation counter value based on a number of printed sheets and activating a pick mechanism to sense a media stack height based on the updated pick mechanism activation counter value.
Figure 4:
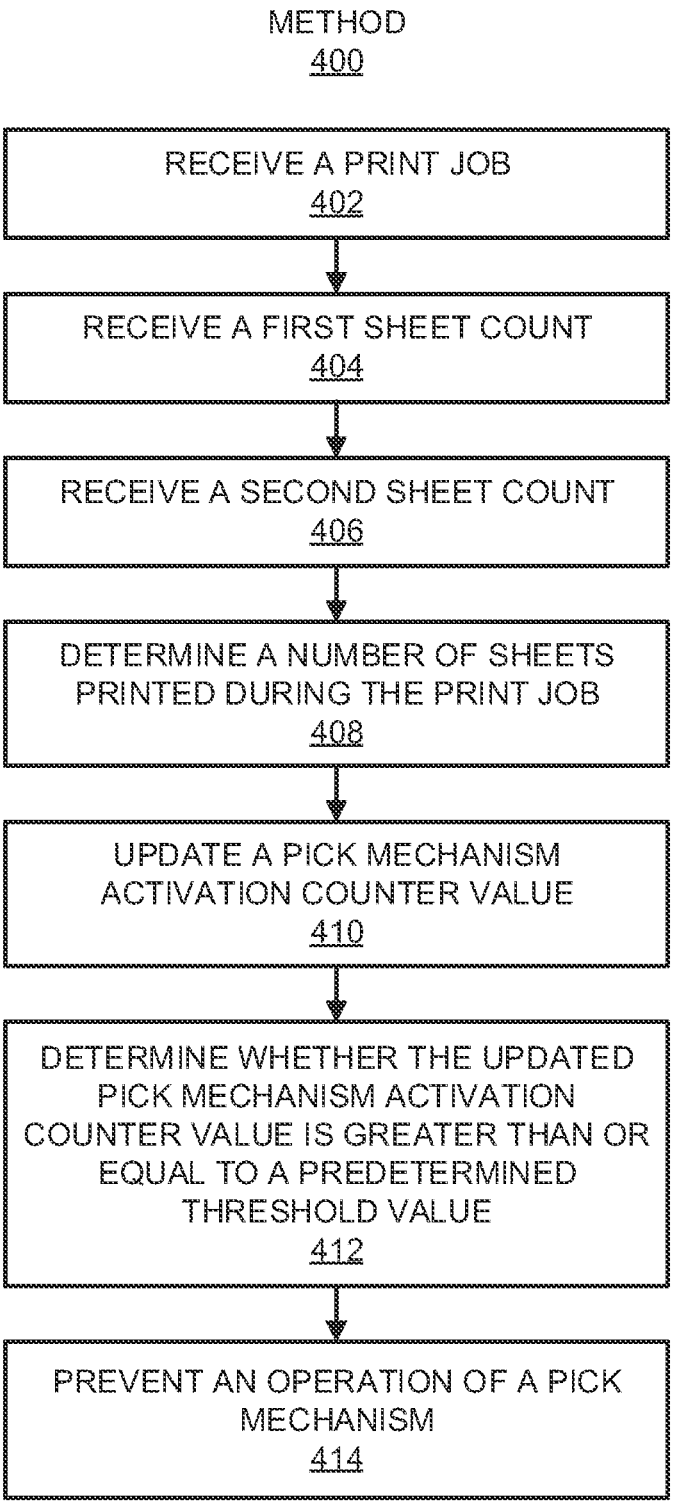
FIG. 4 depicts a flow diagram of an example method for updating a pick mechanism activation counter value based on a number of printed sheets and preventing an operation of a pick mechanism to determine a media stack height of print media.

Various manners in which the processor 102 may operate are discussed in greater detail with respect to the methods 300 and 400, respectively depicted in FIGS. 3 and 4. FIG. 3 depicts a flow diagram of an example method 300 for updating a pick mechanism activation counter value based on a number of printed sheets and activating a pick mechanism to sense a media stack height based on the updated pick mechanism activation counter value. FIG. 4 depicts a flow diagram of an example method 400 for updating a pick mechanism activation counter value based on a number of printed sheets and preventing an operation of a pick mechanism to determine a media stack height of print media. It should be understood that the methods 300 and 400 respectively depicted in FIGS. 3 and 4 may include additional operations and that some of the operations described therein may be removed and/or modified without departing from the scope of the methods 300 and 400. The descriptions of the methods 300 and 400 are made with reference to the features depicted in FIGS. 1 and 2 for purposes of illustration.

Referring first to FIG. 3, at block 302, the processor 102 may start a print job 206. The processor 102 may start the print job 206 at a printing device, which may be the apparatus 100 or a printing device connected to the apparatus 100. At block 304, the processor 102 may receive a first sheet count before execution of the print job 206. At block 306, the processor 102 may execute the print job 206, and at block 308, once the print job 206 has been executed and all of the sheets in the print job 206 have been printed, the processor 102 may receive a second sheet count 210. The first sheet count 208 and the second sheet count 210 may correlate to a number of sheets printed in the printing device at a given point in time.

At block 310, the processor 102 may determine a number of sheets printed 212 for the print job 206 based on the first sheet count 208 and the second sheet count 210. The processor 102 may determine the number of sheets printed 212 based on a difference between the second sheet count 210 and the first sheet count 208. At block 312, the processor 102 may end the print job 206.

At block 314, the processor 102 may update a pick mechanism activation counter value 214 based on the determined number of sheets printed 212. The processor 102 may increment the pick mechanism activation counter value 214 by the determined number of sheets printed 212 during the execution of the print job to update the pick mechanism activation counter value 214.

At block 316, the processor 102 may determine whether to override the pick mechanism activation counter value 214, which may cause the pick mechanism 218 to activate. In some examples, the processor 102 may generate a corrected media stack height using a model, such as a linear regression model that may fine tune the media stack height 220 based on the number of sheets printed 212 in the print job 206 and previous media stack height values. In some examples, the model may be reset based on certain events, for instance, when a print media tray is removed from and re-inserted into the apparatus 100, in which case a media stack height may be unknown since a user may fill the print media tray to any level. In these instances, the processor 102 may override the pick mechanism activation counter value 214 in order to obtain additional data points to rebuild the model for stack height correction. For instance, the processor 102 may cause the pick mechanism 218 to be actuated to sense the media stack height 220 of print media while the updated pick mechanism activation counter value 214 is less than the predetermined threshold value 216. The processor 102 may override the pick mechanism activation counter value 214 for a predetermined number of actuations of the pick mechanism 218.

At block 318, the processor 102 may determine whether the updated pick mechanism activation counter value 214 is greater than or equal to a predetermined threshold value 216, or less than the predetermined threshold value 216.

At block 320, the processor 102 may initialize the updated pick mechanism activation counter value 214 to a predetermined initial value. For instance, the processor 102 may reset the pick mechanism activation counter value 214 to 0, or some other value. The processor 102 may initialize the updated pick mechanism activation counter value 214 based on a determination that the updated pick mechanism activation counter value 214 is greater than or equal to the predetermined threshold value 216. In some examples, the processor 102 may initialize the updated pick mechanism activation counter value 214 based on a determination to override the pick mechanism activation counter value 214.

At block 322, the processor 102 may cause a pick mechanism 218 to be actuated to sense a media stack height 220 of print media.

At block 324, the processor 102 may generate a corrected value for the media stack height 220 using a data fusion model. The media stack height 220 may be a raw media stack height reading based on movement of the pick mechanism 218. The processor 102 may use the data fusion model to improve an accuracy of the media stack height 220 based on the raw media stack height reading for the print job 206, previous media stack height readings, and the number of sheets printed 212 during the print job 206. In some examples, the data fusion model may be a linear regression model, or the like. At block 326, the processor 102 may output the corrected media stack height 220, for instance, to UI clients or to print services that may reside on the server 204.

Based on a determination that the updated pick mechanism activation counter value 214 is less than the predetermined threshold value 216, at block 318, the processor 102 may prevent operation of the pick mechanism 218 to sense the media stack height 220 of the print media. In some examples, the processor 102 may cause a state of pick mechanism 218 to be set in a standby mode. At block 328, the processor 102 may carry forward the updated pick mechanism activation counter value 214 for use in a subsequent print job.

At block 330, the processor 102 may determine that a predetermined event has occurred, such as a printing device start-up, or the like. At block 332, the processor 102 may initialize the pick mechanism activation counter value 214 to a predetermined initial value, such as 0, or some other value. The processor 102 may initialize the pick mechanism activation counter value 214 prior to starting the print job in block 302.

Referring to FIG. 4, the processor 102 may update a pick mechanism activation counter value 214 based on a number of sheets printed 212 and may prevent an operation of a pick mechanism 218 to determine a media stack height 220 of print media. At block 402, the processor 102 may receive a print job 206. At block 404, the processor 102 may receive a first sheet count 208 before printing of the print job 206. At block 406, the processor 102 may receive a second sheet count 210 after printing of the print job 206.

At block 408, the processor 102 may determine a number of sheets printed 212 during the print job 206 based on a difference between the first sheet count 208 and the second sheet count 210. At block 410, the processor 102 may update a pick mechanism activation counter value 214 based on the determined number of sheets printed 212. The pick mechanism activation counter value 214 may represent a number of sheets printed since a previous actuation of the pick mechanism 218.

At block 412, the processor 102 may determine whether the updated pick mechanism activation counter value 214 is greater than or equal to a predetermined threshold value 216. At block 414, based on a determination that the updated pick mechanism activation counter value 214 is less than the predetermined threshold value 216, the processor 102 may prevent an operation of a pick mechanism 218 to determine a media stack height 220 of print media in a print media tray 222.

In some examples, based on a determination that the updated pick mechanism activation counter value 214 exceeds or equals the predetermined threshold value 216, the processor 102 may cause the pick mechanism 218 to determine the media stack height 220 of the print media in the print media tray 222. The processor 102 may initialize the updated pick mechanism activation counter value 214 to a predetermined initial value, such as to 0, after the pick mechanism 218 is actuated.

In some examples, the processor 102 may increment the pick mechanism activation counter value 214 by the determined number of sheets printed 212 during printing of the print job 206 to update the pick mechanism activation counter value 214.

In some examples, based on a determination that the updated pick mechanism activation counter value 214 is less than the predetermined threshold value 216, the processor 102 may carry forward the updated pick mechanism activation counter value 214 for a subsequent print job. In some examples, based on a determination of a printing device start-up, the processor 102 may initialize the pick mechanism activation counter value 214 to a predetermined initial value, such as to 0.

In some examples, the processor 102 may override the updated pick mechanism activation counter value 214 based on certain events. For instance, based on a predetermined event, such as re-insertion of a print media tray 222, the processor 102 may cause the pick mechanism 218 to be actuated while the updated pick mechanism activation counter value 214 is less than the predetermined threshold value 216.

In some examples, the processor 102 may use a model to improve an accuracy of the media stack height 220, which may account for actual sensed values of the media stack height 220 from the pick mechanism 218, previous media stack height values, and the number of sheets printed in the print job 206. Certain events, such as re-insertion of the print media tray 222, may cause the processor 102 to rebuild the model. For instance, based on a predetermined event that may cause the model to be generated, the processor 102 may allow the actuation of the pick mechanism 218, while the updated pick mechanism activation counter value 214 is less than the predetermined threshold value 216. The processor 102 may override the updated pick mechanism activation counter value 214 for a predetermined threshold number of actuations of the pick mechanism 218. In some examples, the processor 102 may decrease the predetermined threshold value 216, which may increase a rate in which the pick mechanism 218 is actuated. Alternatively, the processor 102 may increase the predetermined threshold value 216, which may decrease the rate in which the pick mechanism 218 is actuated.

Some or all of the operations set forth in the methods 300 and 400 may be included as utilities, programs, or subprograms, in any desired computer accessible medium. In addition, the methods 300 and 400 may be embodied by computer programs, which may exist in a variety of forms both active and inactive. For example, they may exist as computer-readable instructions, including source code, object code, executable code or other formats. Any of the above may be embodied on a non-transitory computer-readable storage medium.

Examples of non-transitory computer-readable storage media include computer system RAM, ROM, EPROM, EEPROM, and magnetic or optical disks or tapes. It is therefore to be understood that any electronic device capable of executing the above-described functions may perform those functions enumerated above.

Figure 5:
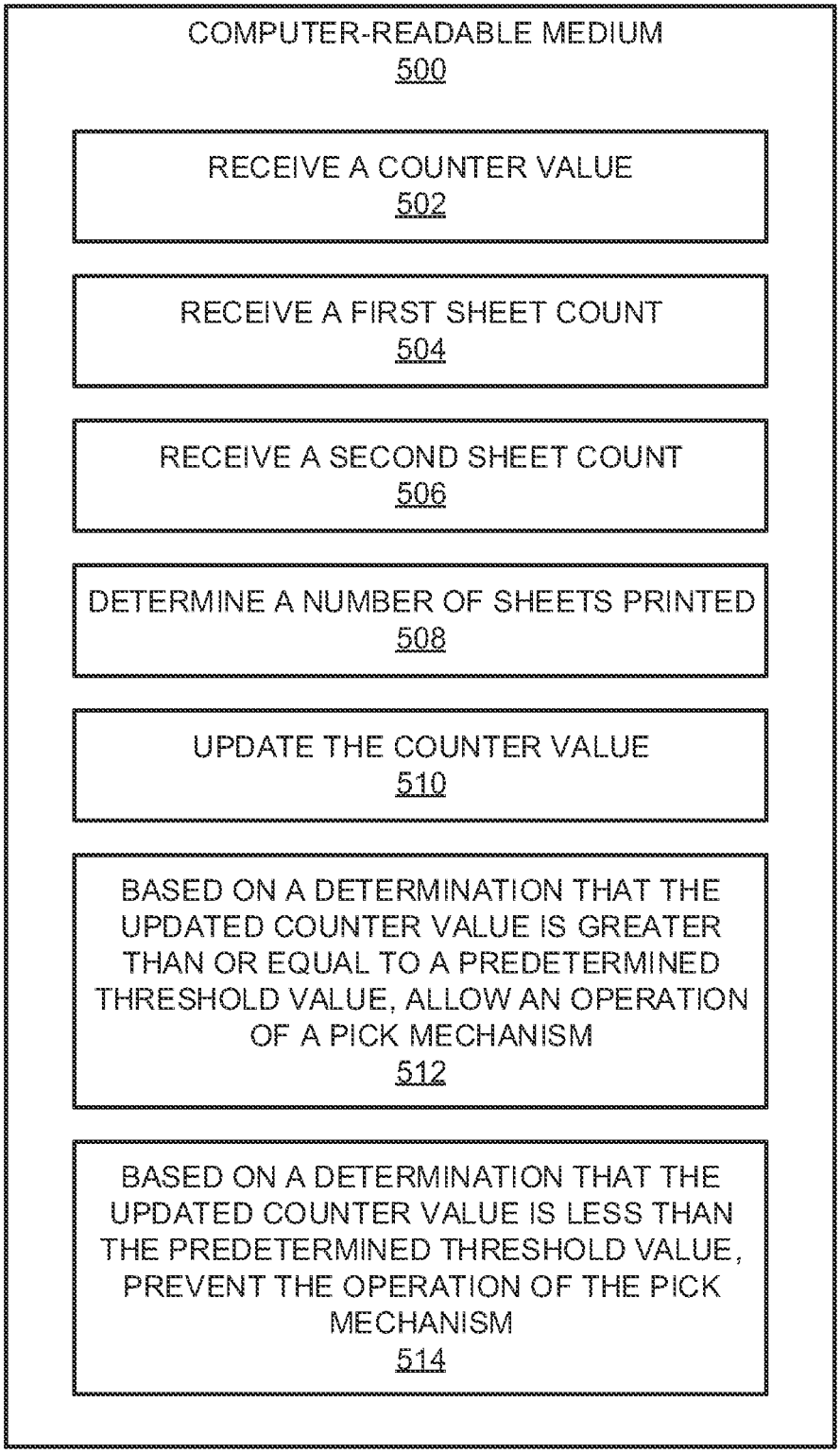
FIG. 5 depicts a block diagram of an example non-transitory computer-readable medium that may have stored thereon computer-readable instructions to update a pick mechanism activation counter value and, based on the updated pick mechanism activation counter value relative to a threshold value, may allow or prevent an operation of a pick mechanism to sense a media stack height of print media.

Turning now to FIG. 5, there is shown a block diagram of a non-transitory computer-readable medium 500 that may have stored thereon computer-readable instructions to update a pick mechanism activation counter value and, based on the updated pick mechanism activation counter value relative to a threshold value, may allow or prevent an operation of a pick mechanism to sense a media stack height of print media. It should be understood that the computer-readable medium 500 depicted in FIG. 5 may include additional instructions and that some of the instructions described herein may be removed and/or modified without departing from the scope of the computer-readable medium 500 disclosed herein. The computer-readable medium 500 may be a non-transitory computer-readable medium. The term "non-transitory" does not encompass transitory propagating signals.

The computer-readable medium 500 may have stored thereon computer-readable instructions 502-514 that a processor, such as the processor 102 depicted in FIGS. 1 and 2, may execute. The computer-readable medium 500 may be an electronic, magnetic, optical, or other physical storage device that contains or stores executable instructions. The computer-readable medium 500 may be, for example, Random-Access memory (RAM), an Electrically Erasable Programmable Read-Only Memory (EEPROM), a storage device, an optical disc, or the like.

The processor may fetch, decode, and execute the instructions 502 to receive a pick mechanism activation counter value 214. The pick mechanism activation counter value 214 may represent a number of sheets printed since a previous actuation of a pick mechanism 218. In some examples, the pick mechanism activation counter value 214 may be carried forward from a previous print job or the pick mechanism activation counter value 214 may be an initialized value, for instance, reset to 0 after a printing device start-up.

The processor may fetch, decode, and execute the instructions 504 to receive a first sheet count 208 before execution of a print job 206. The first sheet count 208 may be a count of printed sheets before execution of the print job 206.

The processor may fetch, decode, and execute the instructions 506 to receive a second sheet count 210 after execution of the print job 206. The second sheet count 210 may be a count of printed sheets after execution of the print job 206.

The processor may fetch, decode, and execute the instructions 508 to determine a number of sheets printed 212 for the print job 206 based on a difference between the second sheet count 210 and the first sheet count 208.

The processor may fetch, decode, and execute the instructions 510 to update the pick mechanism activation counter value 214 by incrementing the pick mechanism activation counter value 214 by the determined number of sheets printed 212.

The processor may fetch, decode, and execute the instructions 512 to allow an operation of a pick mechanism 218 to sense a media stack height 220 of print media based on a determination that the updated pick mechanism activation counter value 214 is greater than or equal to a predetermined threshold value 216.

The processor may fetch, decode, and execute the instructions 514 to prevent the operation of the pick mechanism 218 to sense the media stack height 220 of the print media based on a determination that the updated pick mechanism activation counter value 214 is less than the predetermined threshold value 216.

In some examples, based on the determination that the updated pick mechanism activation counter value 214 may be greater than or equal to the predetermined threshold value 216, the processor may cause the pick mechanism 218 to be actuated to sense the media stack height 220 of the print media in a print media tray 222. Based on a determination to actuate the pick mechanism 218, the processor may initialize the updated pick mechanism activation counter value 214 to a predetermined initial value, such as to 0. In some examples, the processor may initialize the updated pick mechanism activation counter value 214 prior to actuation of the pick mechanism 218. The processor may carry forward the initialized pick mechanism activation counter value 214 for a subsequent print job.

Although described specifically throughout the entirety of the instant disclosure, representative examples of the present disclosure have utility over a wide range of applications, and the above discussion is not intended and should not be construed to be limiting, but is offered as an illustrative discussion of aspects of the disclosure.

What has been described and illustrated herein is an example of the disclosure along with some of its variations. The terms, descriptions and figures used herein are set forth by way of illustration and are not meant as limitations. Many variations are possible within the scope of the disclosure, which is intended to be defined by the following claims—and their equivalents—in which all terms are meant in their broadest reasonable sense unless otherwise indicated.

What is claimed is:

1. An apparatus comprising:

a processor; and a memory on which are stored machine-readable instructions that when executed by the processor, cause the processor to:

receive a first sheet count before execution of a print job;

receive a second sheet count after execution of the print job;

determine a number of sheets printed for the print job based on the first sheet count and the second sheet count;

update a pick mechanism activation counter value based on the determined number of sheets printed;

determine whether the updated pick mechanism activation counter value is greater than or equal to a predetermined threshold value; and based on a determination that the updated pick mechanism activation counter value is greater than or equal to the predetermined threshold value, cause a pick mechanism to be actuated to sense a media stack height of print media.

2. The apparatus of claim 1, further comprising a print media tray, wherein the processor is to cause the pick mechanism to be actuated to sense the media stack height of print media in the print media tray.

3. The apparatus of claim 1, further comprising:

increment the pick mechanism activation counter value by the determined number of sheets printed during the execution of the print job to update the pick mechanism activation counter value.

4. The apparatus of claim 1, further comprising:

based on the actuation of the pick mechanism, initialize the updated pick mechanism activation counter value to a predetermined initial value.

5. The apparatus of claim 1, further comprising:

based on a determination that the updated pick mechanism activation counter value is less than the predetermined threshold value:

prevent operation of the pick mechanism to sense the media stack height of the print media; and carry forward the updated pick mechanism activation counter value for a subsequent print job.

6. The apparatus of claim 1, further comprising:

decrease the predetermined threshold value to increase a rate in which the pick mechanism is actuated and increase the predetermined threshold value to decrease the rate in which the pick mechanism is actuated.

7. The apparatus of claim 1, further comprising:

based on a predetermined event to cause a media stack height correction model to be generated, the media stack height correction model to correct the media stack height based on the number of sheets printed, cause the pick mechanism to be actuated to sense the media stack height of print media while the updated pick mechanism activation counter value is less than the predetermined threshold value, for a predetermined threshold number of actuations of the pick mechanism.

8. A method comprising:

receiving, by a processor, a print job;

receiving, by the processor, a first sheet count before printing of the print job;

receiving, by the processor, a second sheet count after printing of the print job;

determining, by the processor, a number of sheets printed during the print job based on a difference between the first sheet count and the second sheet count;

updating, by the processor, a pick mechanism activation counter value based on the determined number of sheets printed;

determining, by the processor, whether the updated pick mechanism activation counter value is greater than or equal to a predetermined threshold value; and based on a determination that the updated pick mechanism activation counter value is less than the predetermined threshold value, preventing, by the processor, an operation of a pick mechanism to determine a media stack height of print media in a print media tray.

9. The method of claim 8, further comprising:

based on a determination that the updated pick mechanism activation counter value exceeds or equals the predetermined threshold value, cause the pick mechanism to determine the media stack height of the print media in the print media tray.

10. The method of claim 8, further comprising:

incrementing the pick mechanism activation counter value by the determined number of sheets printed during printing of the print job to update the pick mechanism activation counter value.

11. The method of claim 8, further comprising:

initializing the updated pick mechanism activation counter value to a predetermined initial value after the pick mechanism is actuated.

12. The method of claim 8, further comprising:

based on a determination that the updated pick mechanism activation counter value is less than the predetermined threshold value, carrying forward the updated pick mechanism activation counter value for a subsequent print job; and based on a determination of a printing device start-up, initializing the pick mechanism activation counter value to a predetermined initial value.

13. The method of claim 8, further comprising:

based on a predetermined event to cause a media stack height correction model to be generated, the media stack height correction model being to correct the media stack height based on the number of sheets printed, causing an actuation of the pick mechanism while the updated pick mechanism activation counter value is less than the predetermined threshold value, for a predetermined threshold number of actuations of the pick mechanism; and/or decreasing the predetermined threshold value to increase a rate in which the pick mechanism is actuated or increasing the predetermined threshold value to decrease the rate in which the pick mechanism is actuated.

14. A non-transitory computer readable medium on which is stored machine readable instructions that, when executed by a processor, cause the processor to:

receive a pick mechanism activation counter value;

receive a first sheet count before execution of a print job, the first sheet count being a count of printed sheets before execution of the print job;

receive a second sheet count after execution of the print job, the second sheet count being a count of printed sheets after execution of the print job;

determine a number of sheets printed for the print job based on a difference between the second sheet count and the first sheet count;

update the pick mechanism activation counter value by incrementing the pick mechanism activation counter value by the determined number of sheets printed; and one of:

based on a determination that the updated pick mechanism activation counter value is greater than or equal to a predetermined threshold value, allow an operation of a pick mechanism to sense a media stack height of print media; or based on a determination that the updated pick mechanism activation counter value is less than the predetermined threshold value, prevent the operation of the pick mechanism to sense the media stack height of the print media.

15. The non-transitory computer readable medium of claim 14, wherein the instructions cause the processor to:

based on the determination that the updated pick mechanism activation counter value is greater than or equal to the predetermined threshold value, cause the pick mechanism to be actuated to sense the media stack height of the print media in a media tray; and based on the actuation of the pick mechanism, initialize the updated pick mechanism activation counter value to a predetermined initial value and carry forward the initialized pick mechanism activation counter value for a subsequent print job.

* * * * *